United States Patent [19]

Sugiyama

[11] Patent Number: 4,520,695

[45] Date of Patent: Jun. 4, 1985

[54] OPENING MEANS FOR POWDER VESSEL

[75] Inventor: Hiroaki Sugiyama, Numazu, Japan

[73] Assignee: Ricoh Company, Ltd., Tokyo, Japan

[21] Appl. No.: 573,436

[22] Filed: Jan. 24, 1984

[30] Foreign Application Priority Data

Feb. 7, 1983 [JP] Japan ..... 58-16363[U]

[51] Int. Cl.[3] ..... B67B 7/40

[52] U.S. Cl. ..... 81/3.07; 220/284; 7/156

[58] Field of Search ..... 81/3.34; 220/284; 7/156

[56] References Cited

U.S. PATENT DOCUMENTS

| | | | |
|---|---|---|---|
| 1,461,151 | 7/1923 | Keeler | 81/3.34 |
| 2,624,489 | 1/1953 | Wishart | 220/284 |
| 2,839,221 | 6/1958 | Demaret | 7/156 |

FOREIGN PATENT DOCUMENTS

| | | | |
|---|---|---|---|
| 813653 | 9/1951 | Fed. Rep. of Germany | 81/3.34 |

*Primary Examiner*—Roscoe V. Parker

*Attorney, Agent, or Firm*—Flynn, Thiel, Boutell & Tanis

[57] ABSTRACT

An opening means for a vessel which has received powder therein. A handle is provided at one end of a hollow tubular body, and a substantially axially extending slit is provided on the opposite side of the body. Furthermore, a projection is formed on the outer wall of the body. This projection is located so that upon opening, it may pierce the cover means and penetrate it through immediately before peeling off of the cover means starts. This projection is provided with a through hole which has communication between the inside and outside portions of the body of the opening means.

1 Claim, 8 Drawing Figures

OPENING MEANS FOR POWDER VESSEL

FIELD OF THE INVENTION

This invention relates to an opening means for a powder vessel, in particular a toner vessel for use in a copying machine.

BACKGROUND OF THE INVENTION

As the powder vessel such as said toner vessel, although of course not limited thereto, there has usually been used the one illustrated in FIG. 1, wherein a vessel body 1 is filled with powder 4 as shown in FIG. 3, thereafter an opening portion 3 of said vessel body is covered with a cover means 2, and one end 2' of said cover means 2 is bent upwards.

The opening means which has usually been used for stripping the cover means 2 and uncovering the powder vessel as mentioned above is illustrated at 15 in FIG. 2.

This opening means 15 comprises providing a flat handle 17 in a projecting manner at one end of a hollow tubular body 16 and further providing an axially extending slit 18 at a part of the body 16 on the side opposite to said handle 17. Upon uncovering the powder vessel using this opening means 15, the end 2' of the cover means 2 is inserted in the slit 18, and the opening means 15 is turned clockwisely in FIG. 3 with the handle 17. As the result of this, the cover means 2 is gradually wound around the body 16 of the opening means 15 and is uncovered.

However, the above vessel is defective in that since the body 1 is filled with powder 4 and thereafter its opening portion is wholly tightly closed with the cover means 2, the air within the vessel tends to expand as the temperature rises and the internal pressure increases, whereby at the first time of uncovering, a part 4' of the powder 4 spouts out of the vessel as shown in FIG. 3 and is scattered thereabout to cause environmental pollution.

SUMMARY OF THE INVENTION

An object of this invention is to eliminate the drawbacks to be caused when opening the powder vessel by means of the opening means of the above mentioned type and to prevent the occurrence of environmental pollution to be caused by the use of the aforesaid opening means that a part of the powder, received in the vessel, spouts out, is scattered and pollutes the circumference.

Said object can be achieved by the provision of an opening means according to this invention which comprises forming a projection on the outer wall of a hollow tubular body with a handle and a slit as in the conventional opening means, said projection being located so that it, upon opening, may pierce a cover means and penetrate it through immediately before peeling off of said cover means starts, and providing this projection with a through hole which has communication between the inside and outside portions of the body of the opening means.

DETAILED DESCRIPTION OF THE INVENTION

Figure 1:
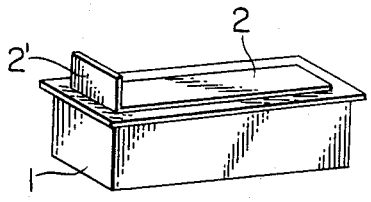
FIG. 1 is a perspective view of a hitherto used powder vessel to be opened by an opening means according to this invention.
Figure 2:
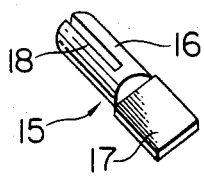
FIG. 2 PRIOR ART
FIG. 2 is a perspective view of a hitherto used opening means.
Figure 3:
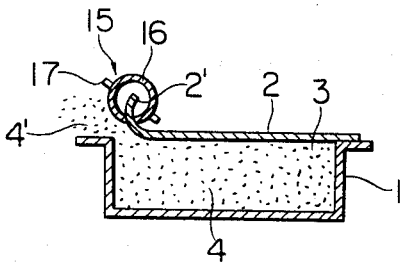
FIG. 3 PRIOR ART
FIG. 3 is a vertical front view illustrating the state of opening the powder vessel shown in FIG. 1 by means of the opening means shown in FIG. 2.
Figure 4:
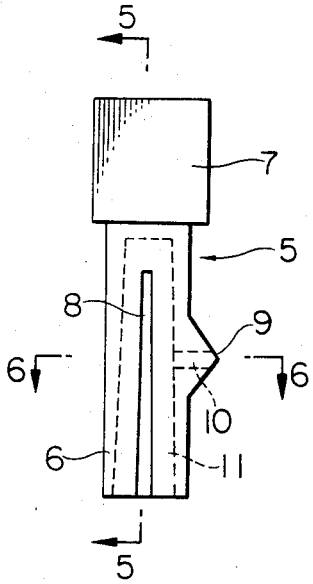
FIG. 4 is a front view of a preferable opening means embodying this invention.
Figure 5:
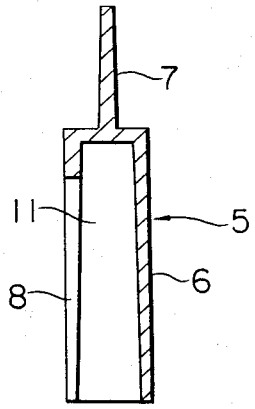
FIG. 5 is a view taken in the direction of the arrows along the line 5—5 of FIG. 4.
Figure 6:
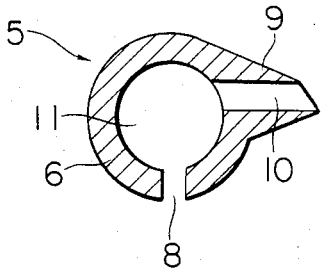
FIG. 6 is a view taken in the direction of the arrows along the lines 6—6 of FIG. 4.

FIG. 4 and following illustrate preferable opening means embodying this invention. In this opening means 5, reference numeral 6 denotes a hollow body, 7 denotes a handle and 8 denotes a slit. In these respect, this opening means is similar in structure to said conventional opening means 15 consisting of the body 16, the handle 17 and the slit 18. Accordingly, detailed explanation of the preferred embodiment of this invention will be omitted and explanation will be made of mainly the different points lying therebetween.

In this embodiment, a projection 9 is provided on the outer wall of the body 6 located at the rear of the rotating direction relative to the slit 8, and this projection 9 is provided with a through hole 10 which has communication between the inside and outside portions of the body 6. The location of this projection 9 is selected.

Figure 7:
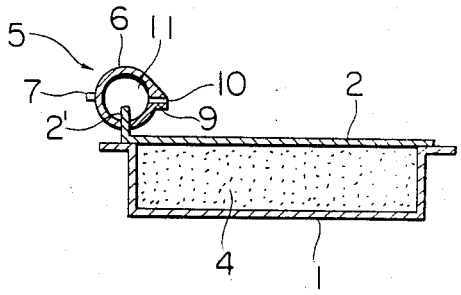
FIG. 7 and FIG. 8 are longitudinal sectional front views illustrating the state of opening the powder vessel by means of the opening means of FIG. 4 in order.
Figure 8:
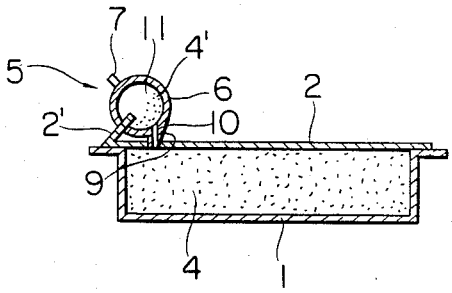

How to use said opening means 5 is shown in FIG. 7 and FIG. 8. That is, upon opening, an erect end portion 2' of the opening means 2 is inserted, as usual, in the slit 8 (FIG. 7) and the opening means 5 is rotated clockwise with the handle 7.

Due to this rotation, the end portion 2' is bent, and simultaneously the projection 9 abuts on the surface of the cover means 2 and thereafter bursts and penetrates through it. As the result of this penetration, part 4' of the powder 4 within the vessel is entrained in spouting air flow and flows in the hollow chamber 11 of the body 6 through the through hole 10 (FIG. 8). The powder 4' is stagnant here without a risk of dispersing thereabout.

The powder, which is thus stagnant within the opening means 5, is cast aside at a dumping place from the hollow chamber 11 after the opening operation is completed, whereby there is no possibility that the circumference of the opening works is polluted.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In an opening means for peeling a cover means from a powder receiving vessel, which cover means cover an opening of said vessel, said opening means comprising a hollow tubular body having ends and an outer wall and a hollow inside portion, said body being provided with a handle portion at one said end, said body having a substantially axially extending slit in said outer wall at the end of said body opposite to this handle, the improvement comprising a projection on the outer wall of said body, said projection being located so as t pierce the cover means and penetrate it through, upon opening, immediately before peeling off of the cover means starts, this projection having a through hole communicating through said outer wall from the inside portion of said body to outside of said body.

* * * * *